US008291735B1

(12) United States Patent
Damikolas

(10) Patent No.: US 8,291,735 B1
(45) Date of Patent: Oct. 23, 2012

(54) REKEYABLE LOCK CYLINDER HAVING ROTATABLE KEY FOLLOWERS

(75) Inventor: Gerry Damikolas, Upland, CA (US)

(73) Assignee: Newfrey, LLC, Newark, DE (US)

( * ) Notice: Subject to any disclaimer, the term of this patent is extended or adjusted under 35 U.S.C. 154(b) by 49 days.

(21) Appl. No.: 13/076,589

(22) Filed: Mar. 31, 2011

(51) Int. Cl.
*E05B 25/00* (2006.01)

(52) U.S. Cl. ..... 70/383; 70/337; 70/384; 70/385; 70/368; 70/494; 70/495

(58) Field of Classification Search ..... 70/337–343, 70/349, 382–385, 368, 492–496, DIG. 21, 70/DIG. 23, DIG. 25
See application file for complete search history.

(56) References Cited

U.S. PATENT DOCUMENTS 1,565,556 A 12/1925 Fremon
1,610,224 A 12/1926 Dalboni et al.
1,845,867 A 2/1932 Ellingson
1,965,889 A 7/1934 Gerald
2,139,842 A 12/1938 Miller
2,194,469 A * 3/1940 Fremon ..... 70/493
2,232,017 A 2/1941 Wilder
2,370,862 A 3/1945 Johnstone
2,391,832 A 12/1945 Johnstone
2,895,323 A 7/1959 Kennedy
2,977,786 A 4/1961 Kendrick et al.
3,149,486 A 9/1964 Russell et al.
3,183,692 A 5/1965 Check
3,190,093 A 6/1965 Schlage
3,261,189 A 7/1966 Best
3,293,892 A 12/1966 Falik
3,320,781 A 5/1967 Hill
3,431,757 A 3/1969 Hori
3,589,153 A 6/1971 Hill
3,667,262 A 6/1972 Hill
3,693,384 A 9/1972 Genakis
3,726,116 A 4/1973 Di Motta
3,728,880 A 4/1973 Falk
3,735,612 A 5/1973 Popovici
3,754,422 A 8/1973 Stackhouse
3,788,111 A 1/1974 Parlier
3,824,818 A 7/1974 Neale
3,910,083 A * 10/1975 Burlingame ..... 70/383

(Continued)

FOREIGN PATENT DOCUMENTS

CA 2333329 A1 12/1999

(Continued)

*Primary Examiner* — Lloyd Gall
*Assistant Examiner* — Richard G Davis
(74) *Attorney, Agent, or Firm* — Richard J. Veltman, Esq.; Aust IP Law; Ronald K. Aust, Esq.

(57) ABSTRACT

A rekeyable lock cylinder includes a lock cylinder body having an interior void and a plug assembly rotatably disposed in the lock cylinder body. The plug assembly includes a plug body having a keyway. A plurality of racks is movably disposed relative to the plug body. A plurality of key followers is positioned across the keyway and is moveably disposed relative to the plug body. Each key follower is configured to engage a respective rack of the plurality of racks. A key follower rotation member is drivably engaged with each key follower of the plurality of key followers. The key follower rotation member is selectively movable to rotate each key follower of the plurality of key followers to thereby disengage each key follower of the plurality of key followers from the respective rack of the plurality of racks to facilitate a keying of the rekeyable lock cylinder.

19 Claims, 6 Drawing Sheets

U.S. PATENT DOCUMENTS 3,974,671 A 8/1976 Rossetti
3,990,282 A 11/1976 Sorum
3,999,413 A 12/1976 Raymond et al.
4,015,458 A 4/1977 Mercurio
4,031,729 A 6/1977 Gretler
4,069,694 A 1/1978 Raymond et al.
4,094,175 A 6/1978 Pechner
4,142,391 A 3/1979 Paig
4,195,504 A 4/1980 Foshee
4,320,639 A 3/1982 Kleefeldt et al.
4,372,139 A 2/1983 Laake
4,376,382 A 3/1983 Raymond et al.
4,377,940 A 3/1983 Hucknall
4,380,163 A 4/1983 Reder
4,393,673 A 7/1983 Widen
4,404,824 A 9/1983 Hennessy
4,412,437 A 11/1983 Smith
4,440,009 A 4/1984 Smith
4,689,978 A 9/1987 Drummond
4,712,399 A 12/1987 Mattossovich
4,712,401 A 12/1987 Monahan
4,712,402 A 12/1987 Monahan
4,723,427 A 2/1988 Oliver
4,729,231 A 3/1988 Wu
4,732,023 A 3/1988 Shen
4,741,188 A 5/1988 Smith
4,747,281 A 5/1988 Monahan
4,765,163 A 8/1988 Trull et al.
4,794,772 A 1/1989 Falk et al.
4,836,002 A 6/1989 Monahan
4,850,210 A 7/1989 Adler et al.
4,899,563 A 2/1990 Martin
4,909,053 A 3/1990 Zipf, III et al.
4,912,953 A 4/1990 Wobig
4,920,774 A 5/1990 Martin
4,942,749 A 7/1990 Rabinow
4,966,021 A 10/1990 Boag
4,996,856 A 3/1991 Lin et al.
5,000,019 A 3/1991 Foster
5,010,753 A 4/1991 Boris, Jr.
5,024,071 A 6/1991 Shafirkin
5,038,589 A 8/1991 Martin
5,044,180 A 9/1991 Lebrecht
5,044,185 A 9/1991 Green
5,050,412 A 9/1991 Errani
5,070,716 A 12/1991 Whorlow
5,076,081 A 12/1991 Boris, Jr.
5,088,305 A 2/1992 Myers
5,121,619 A 6/1992 Martin
5,174,136 A 12/1992 Thwing
5,209,088 A 5/1993 Vaks
5,211,044 A 5/1993 Kim
5,233,850 A * 8/1993 Schroeder ..... 70/337
5,291,767 A 3/1994 Weindorf, Jr. et al.
5,325,690 A 7/1994 Adler et al.
5,428,978 A 7/1995 Tsukano
5,431,034 A 7/1995 Fann et al.
5,479,801 A 1/1996 Keller
5,507,162 A 4/1996 Chhatwal
5,540,071 A 7/1996 Reikher
5,640,865 A 6/1997 Widen
5,666,835 A 9/1997 Keller
5,704,234 A 1/1998 Resch
5,718,136 A 2/1998 Aldieri et al.
5,752,400 A 5/1998 Kim
5,765,417 A 6/1998 Bolton
5,791,181 A 8/1998 Sperber et al.
5,884,512 A 3/1999 Wayne
5,921,122 A 7/1999 Lin
5,921,123 A 7/1999 Schwarzkopf et al.
5,956,986 A 9/1999 Vonlanthen
5,970,760 A 10/1999 Shen
5,979,200 A 11/1999 Cliff
6,029,484 A 2/2000 Jetton
6,047,577 A 4/2000 Klimas
6,076,386 A 6/2000 Etchells et al.
6,079,240 A 6/2000 Shvarts
6,119,495 A 9/2000 Loreti
6,134,928 A 10/2000 Kang
6,142,717 A 11/2000 Staiger
6,295,850 B1 10/2001 Anderson
6,425,274 B1 7/2002 Laitala et al.
6,516,643 B1 2/2003 Olshausen
6,523,378 B2 2/2003 Kuo
6,523,382 B1 2/2003 Dimig et al.
6,532,782 B2 3/2003 Chiu
6,564,601 B2 5/2003 Hyatt, Jr.
6,776,017 B2 8/2004 Herdman
6,860,131 B2 3/2005 Armstrong et al.
6,862,909 B2 3/2005 Armstrong et al.
6,871,520 B2 3/2005 Armstrong et al.
6,959,569 B2 11/2005 Strader et al.
6,968,717 B2 11/2005 Suzuki et al.
7,007,528 B2 3/2006 Chong et al.
7,059,160 B2 6/2006 Keller
7,114,357 B2 * 10/2006 Armstrong et al. ..... 70/492
7,117,701 B2 10/2006 Armstrong et al.
7,213,429 B2 5/2007 Armstrong et al.
7,234,331 B2 6/2007 Armstrong et al.
7,308,811 B2 12/2007 Armstrong et al.
7,322,219 B2 1/2008 Armstrong et al.
7,428,836 B2 9/2008 Yang et al.
7,434,431 B2 10/2008 Armstrong et al.
7,448,239 B1 11/2008 Huang et al.
7,448,240 B1 11/2008 Huang et al.
7,475,578 B2 1/2009 Brown et al.
7,526,935 B2 5/2009 Huang et al.
7,634,931 B2 12/2009 Segien et al.
7,836,739 B2 11/2010 Huang et al.
7,874,191 B2 1/2011 Chiang et al.
2003/0037582 A1 2/2003 Edwards, Jr. et al.
2003/0084692 A1 5/2003 Herdman
2003/0089149 A1 5/2003 Suzuki et al.
2003/0154753 A1 8/2003 Dimig et al.
2004/0069030 A1 4/2004 Takadama
2005/0132766 A1 6/2005 Milo
2005/0229656 A1 10/2005 Brown et al.
2006/0117822 A1 6/2006 Boesel et al.
2008/0271505 A1 11/2008 Armstrong et al.
2008/0314106 A1 12/2008 Mathachan
2009/0031774 A1 2/2009 Armstrong et al.
2010/0050717 A1 3/2010 Chiang et al.

FOREIGN PATENT DOCUMENTS

DE 19544840 A1 6/1997
EP 0157967 A1 10/1985
EP 0210037 A2 1/1987
EP 0526904 A1 2/1993
EP 0872615 A2 10/1998
GB 990987 5/1965
GB 1554877 10/1979
JP 54005360 3/1979
JP 7197705 A 8/1995
JP 2001234648 A 8/2001
WO 9314290 A1 7/1993
WO 9736072 A1 10/1997

* cited by examiner

REKEYABLE LOCK CYLINDER HAVING ROTATABLE KEY FOLLOWERS

CROSS-REFERENCE TO RELATED APPLICATIONS

None.

MICROFICHE APPENDIX

None.

GOVERNMENT RIGHTS IN PATENT

None.

BACKGROUND OF THE INVENTION

1. Field of the Invention

The present invention relates to a lock cylinder, and, more particularly, to a rekeyable lock cylinder having rotatable key followers to facilitate the rekeying of the lock cylinder.

2. Description of the Related Art

When rekeying a cylinder using a traditional cylinder design, the user is required to remove the cylinder plug from the cylinder body and replace the appropriate pins so that a new key can be used to unlock the cylinder. This typically requires the user to remove the cylinder mechanism from the lockset and then disassemble the cylinder to some degree to remove the plug and replace the pins. This requires a working knowledge of the lockset and cylinder mechanism and is usually only performed by locksmiths or trained professionals. Additionally, the process usually employs special tools and requires the user to have access to pinning kits to interchange pins and replace components that can get lost or damaged in the rekeying process. Finally, professionals using appropriate tools can easily pick traditional cylinders.

In U.S. Pat. No. 6,860,131, there is disclosed an embodiment of a rekeyable lock cylinder that includes a cylinder body with a plug body and carrier sub-assembly disposed therein. The plug body includes a plurality of spring-loaded pins and the carrier assembly includes a plurality of racks for engaging the plurality of spring-loaded pins to operate the lock cylinder. A tool is inserted into a tool-receiving aperture on the plug body face to engage the rack carrier and move the rack carrier in a longitudinal direction from an operating position to a rekeying position to disengage the plurality of racks from the plurality of spring-loaded pins to achieve the rekeying position. In the rekeying position, a second key can replace the first valid key. The second key is inserted into the keyway of the plug body, and then the tool is released to cause the rack carrier to return to the operating position to cause the plurality of racks to reengage the plurality of spring-loaded pins to complete the rekeying process.

SUMMARY OF THE INVENTION

The present invention provides a rekeyable lock cylinder having rotatable key followers to facilitate the rekeying of the lock cylinder.

The invention, in one form thereof, is directed to a rekeyable lock cylinder. The rekeyable lock cylinder includes a lock cylinder body including a cylinder wall having an interior surface defining an interior void having a longitudinal axis. A plug assembly is rotatably disposed in the lock cylinder body. The plug assembly includes a plug body having a plug face and a keyway extending into the plug body from the plug face. The keyway is configured to receive a key. A plurality of racks is movably disposed relative to the plug body. A plurality of key followers is positioned across the keyway and is moveably disposed relative to the plug body. Each key follower of the plurality of key followers is configured to engage a respective rack of the plurality of racks. A key follower rotation member is drivably engaged with each key follower of the plurality of key followers. The key follower rotation member is selectively movable to rotate each key follower of the plurality of key followers to thereby disengage each key follower of the plurality of key followers from the respective rack of the plurality of racks to facilitate a keying of the rekeyable lock cylinder.

The invention, in another form thereof, is directed to a rekeyable lock cylinder. The rekeyable lock cylinder includes a lock cylinder body including a cylinder wall having an interior surface defining an interior void having a longitudinal axis. A plug assembly is rotatably disposed in the lock cylinder body. The plug assembly includes a plug body having a plug face and a keyway extending into the plug body from the plug face. The keyway is configured to receive a key. A plurality of racks is movably disposed relative to the plug body. A plurality of key followers is positioned across the keyway and is moveably disposed relative to the plug body. Each key follower of the plurality of key followers is rotatable relative to the plurality of racks. Each key follower of the plurality of key followers has a rotation lever, and each key follower of the plurality of key followers has a rack engagement protrusion. A key follower rotation member is drivably engaged with each rotation lever of each key follower of the plurality of key followers. The key follower rotation member is movable in a first direction to rotate each key follower of the plurality of key followers to thereby disengage each rack engagement protrusion of the plurality of key followers from the respective rack of the plurality of racks. The key follower rotation member is movable in a second direction to rotate each key follower of the plurality of key followers to thereby engage each rack engagement protrusion of the plurality of key followers with the respective rack of the plurality of racks.

The invention, in another form thereof, is directed to a method for keying a lock cylinder. The lock cylinder has a lock cylinder body including a cylinder wall having an interior surface defining an interior void having a longitudinal axis. A plug assembly is rotatably disposed in the lock cylinder body. The plug assembly includes a plug body having a plug face and a keyway extending into the plug body from the plug face. The keyway is configured to receive a key. The plug assembly includes a locking bar, a plurality of racks movably disposed relative to the plug body, and a plurality of key followers positioned across the keyway and being moveably disposed relative to the plug body. The method includes inserting a valid key in the keyway; rotating the plug assembly relative to the lock cylinder body from a home position to a rekeying position wherein a position of each rack of the plurality of racks is maintained by the locking bar; rotating the plurality of key followers to disengage the plurality of key followers from the plurality of racks; removing the valid key from the keyway; inserting a second key into the keyway; rotating the plurality of key followers to reengage the plurality of key followers with the plurality of racks; and rotating the plug assembly relative to the lock cylinder body from the rekeying position to the home position to complete rekeying of the lock cylinder to the second key.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
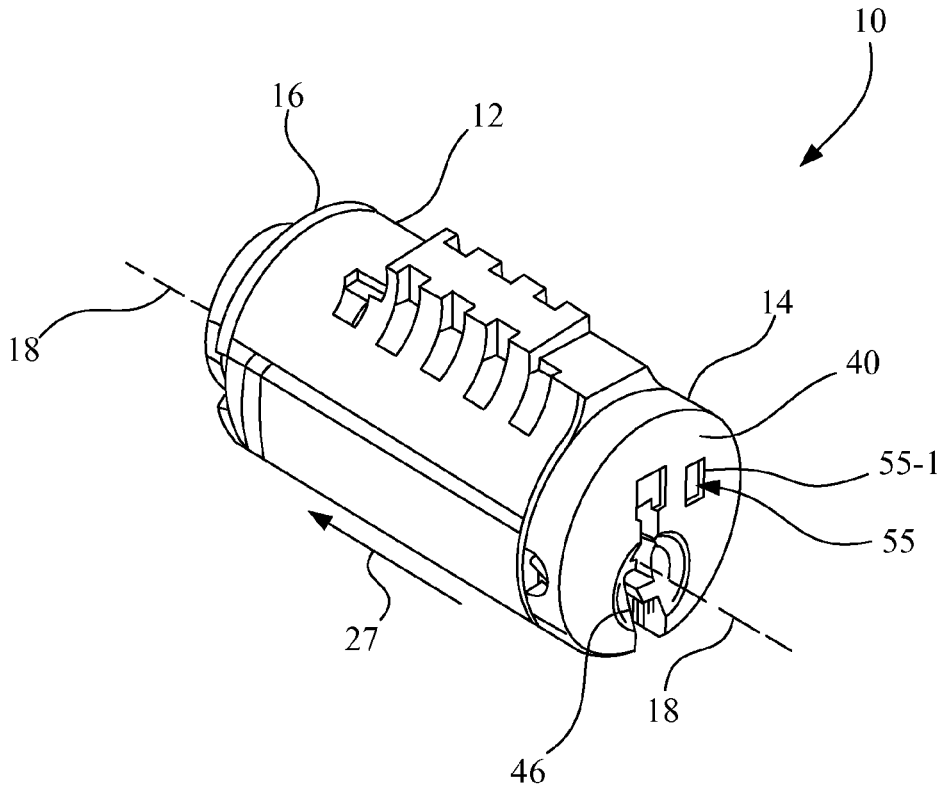
FIG. 1 is a perspective view of a rekeyable lock cylinder configured in accordance with an embodiment of the present invention.

Corresponding reference characters indicate corresponding parts throughout the several views. For convenience, and ease of discussion, both an individual element and a plurality of like individual elements may be referenced by the same element number. The exemplifications set out herein illustrate one embodiment of the invention, in one form, and such exemplifications are not to be construed as limiting the scope of the invention in any manner.

DETAILED DESCRIPTION OF THE INVENTION

Referring now to the drawings and particularly to FIG. 1, there is shown a lock cylinder 10 configured in accordance with an embodiment of the present invention. Lock cylinder 10 includes a lock cylinder body 12, a plug assembly 14 and a retainer 16. Lock cylinder 10 has a longitudinal axis 18 that extends through the central elongate portion of lock cylinder 10.

Figure 2:
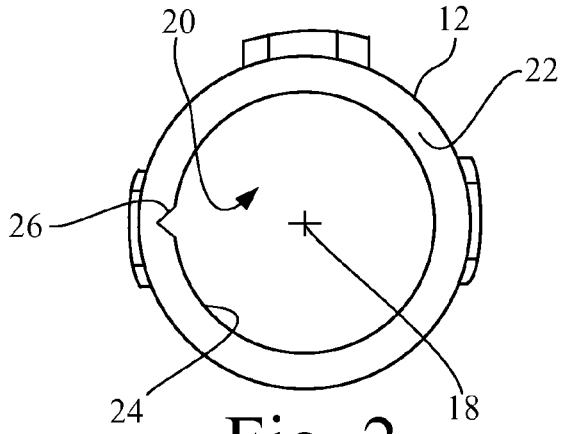
FIG. 2 is a front view of the lock cylinder body of the lock cylinder of FIG. 1, with the plug assembly removed.

Referring also to FIG. 2, lock cylinder body 12 is formed as a generally cylindrical body having an interior void 20 and a cylinder wall 22 having an interior surface 24. Interior surface 24 defines the interior void 20. Plug assembly 14 is rotatably disposed in the interior void 20 of lock cylinder body 12. Retainer 16 retains plug assembly 14 in lock cylinder body 12, and may be in the form of a snap ring.

Longitudinal axis 18 extends through the interior void 20 and defines a corresponding rotational axis 18 for plug assembly 14. Cylinder wall 22 includes an interior, locking bar groove 26 at interior void 20 that extends radially into cylinder wall 22 from interior surface 24. In the present embodiment, locking bar groove 26 is formed as a generally V-shaped notch that extends longitudinally along a portion of lock cylinder body 12 in a direction 27 parallel to longitudinal axis 18.

Referring also to FIGS. 3, 4, 7A and 7B, plug assembly 14 includes a plug body 28, a key follower sub-assembly 30, a plurality of racks 32, a locking bar 34, a pair of locking bar return springs 36, and a cover 38.

Figure 3:
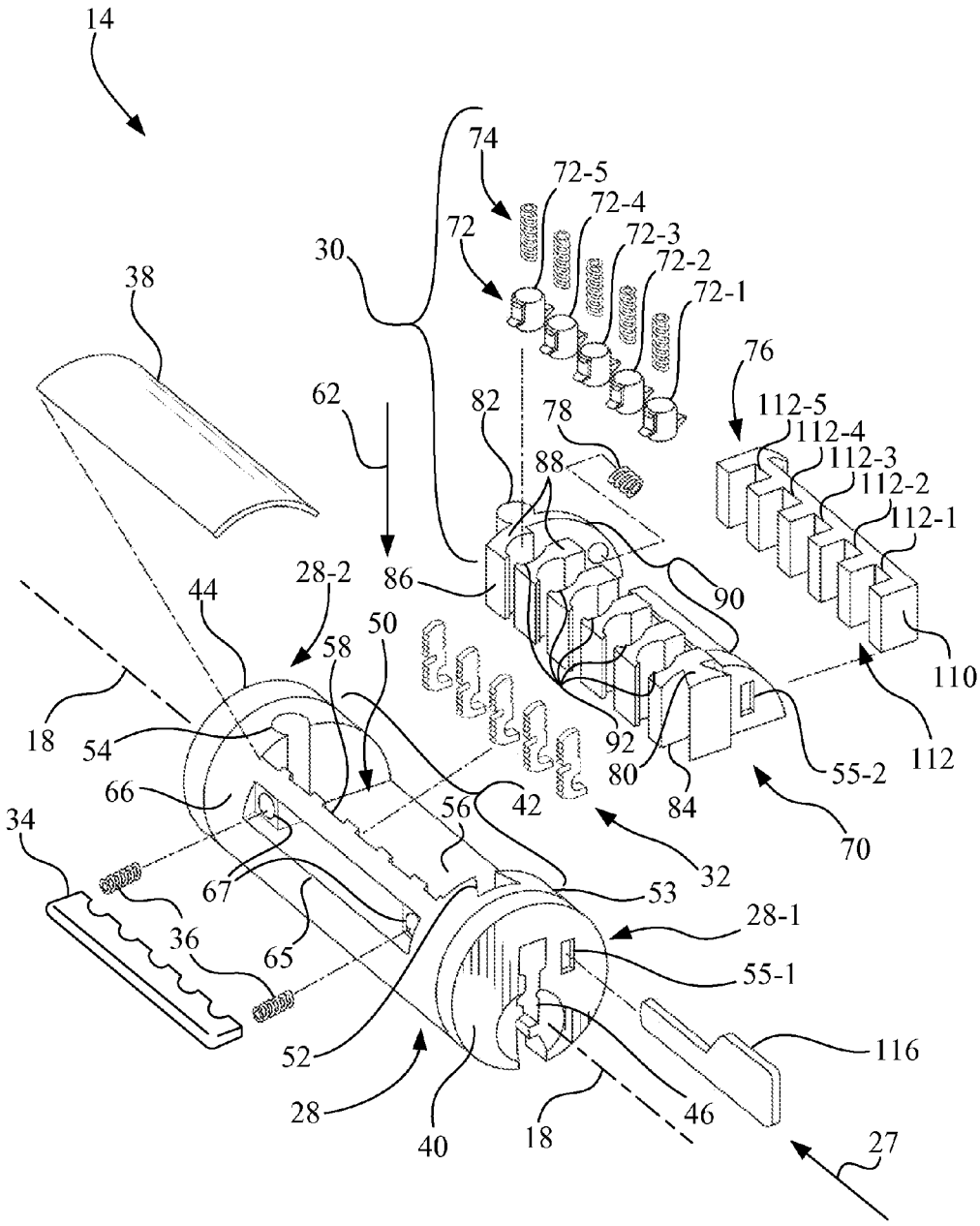
FIG. 3 is an exploded perspective view of the lock cylinder of FIG. 1.

Referring to FIG. 3, plug body 28 has a proximal end 28-1 and a distal end 28-2. Plug body 28 includes a plug face 40, an intermediate portion 42 and a drive portion 44. Drive portion 44 is located at distal end 28-2. A keyway 46 extends from plug face 40 into intermediate portion 42 toward distal end 28-2, with keyway 46 being configured to receive a key 48 for operating lock cylinder 10.

Intermediate portion 42 of plug body 28 is formed as a cylindrical quarter-section void 50 having at proximal end 28-1 with a first key follower sub-assembly guide channel 52 defined in an end wall 53 and having at distal end 28-2 with a second key follower sub-assembly guide channel 54 shaped to receive corresponding features on key follower sub-assembly 30. A rekeying aperture 55-1 extends through end wall 53 to void 50. The quarter-section void 50 of intermediate portion 42 defines a planar surface 56 and a side wall 58, with side wall 58 being substantially perpendicular to planar surface 56. Side wall 58 includes a plurality of rack guide channels 60 (see also FIGS. 7A and 7B) that are arranged in parallel and extend in a direction 62. Direction 62 is defined as a direction that is orthogonal to, but not necessary intersecting, rotational axis 18 and direction 27, and is orthogonal to planar surface 56.

Each of the plurality of rack guide channels 60 is configured to respectively slidably receive a corresponding rack of the plurality of racks 32. In other words, each of the plurality of racks 32 is movably disposed in a respective guide channel of the plurality of rack guide channels 60. Referring again to FIG. 3, each rack of the plurality of racks 32 further includes a locking bar engaging groove 63 and at least one follower engagement groove 64 formed by a pair of teeth. In the embodiment shown in FIG. 4, for example, each rack of the plurality of racks 32 includes a plurality of follower engagement grooves 64 to facilitate a plurality of key lift amounts for rekeying lock cylinder 10.

As shown in FIG. 3, side wall 58 of plug body 28 further includes a locking bar recess 65 configured to receive locking bar 34. Locking bar recess 65 extends inwardly from a curved surface 66 to intersect with each of the plurality of plurality of rack guide channels 60 (see FIGS. 7A and 7B). Locking bar recess 65 is configured to slidably receive locking bar 34. Locking bar recess 65 further includes a pair of return spring-receiving bores 67 for receiving locking bar return springs 36. Return springs 36 bias locking bar 34 outwardly away from rotational axis 18 and toward interior surface 24 of cylinder wall 22 to engage locking bar groove 26 when locking bar 34 is rotationally aligned with locking bar groove 26.

Figure 4:
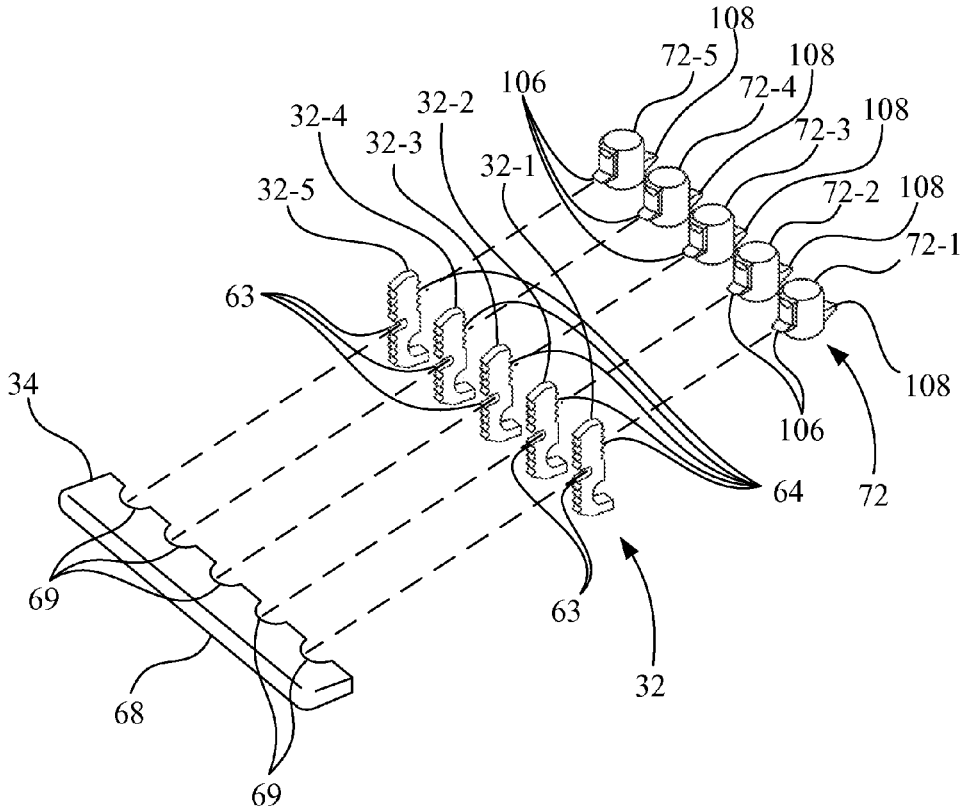
FIG. 4 is an enlarged perspective view of the locking bar, racks and key followers of FIG. 3.

The spring-loaded locking bar 34 is sized and configured to slidably fit in locking bar recess 65 of plug body 28. Referring also to FIG. 4, locking bar 34 is formed as an elongate member having a tapered triangular side edge 68 that is configured to be received by locking bar groove 26 of cylinder wall 22. Opposite the triangular side edge 68, locking bar 34 includes a longitudinally extending gear tooth 69 configured to be selectively received in locking bar engaging grooves 63 of the plurality of racks 32 when locking bar engaging grooves 63 of the plurality of racks 32 are in longitudinal alignment relative to longitudinal axis 18, as is the case when a proper key 48 is inserted into keyway 46 (see also FIGS. 7A and 7B).

Lock cylinder body 12 is configured to prevent a rotation of plug assembly 14 relative to lock cylinder body 12 when no key, or an invalid key, is inserted into keyway 46. For example, when no key, or an invalid key, is inserted into keyway 46, locking bar engaging groove 63 of at least one rack of the plurality of racks 32 is not longitudinally aligned relative to longitudinal axis 18 with at least one other locking bar engaging groove 63 of at least one other rack of said plurality of racks 32 to prevent simultaneous engagement of locking bar 34 with each locking bar engaging groove 63 of the plurality of racks 32, and thus locking bar 34 is retained in locking bar groove 26 of lock cylinder body 12 by one or more of the plurality of racks 32, which prevents rotation of plug assembly 14 relative to lock cylinder body 12.

Referring again to FIG. 3, key follower sub-assembly 30 includes a key follower carrier body 70, a plurality of key followers 72, a plurality of biasing springs 74, a key follower rotation member 76, and a biasing member 78.

Figure 5:
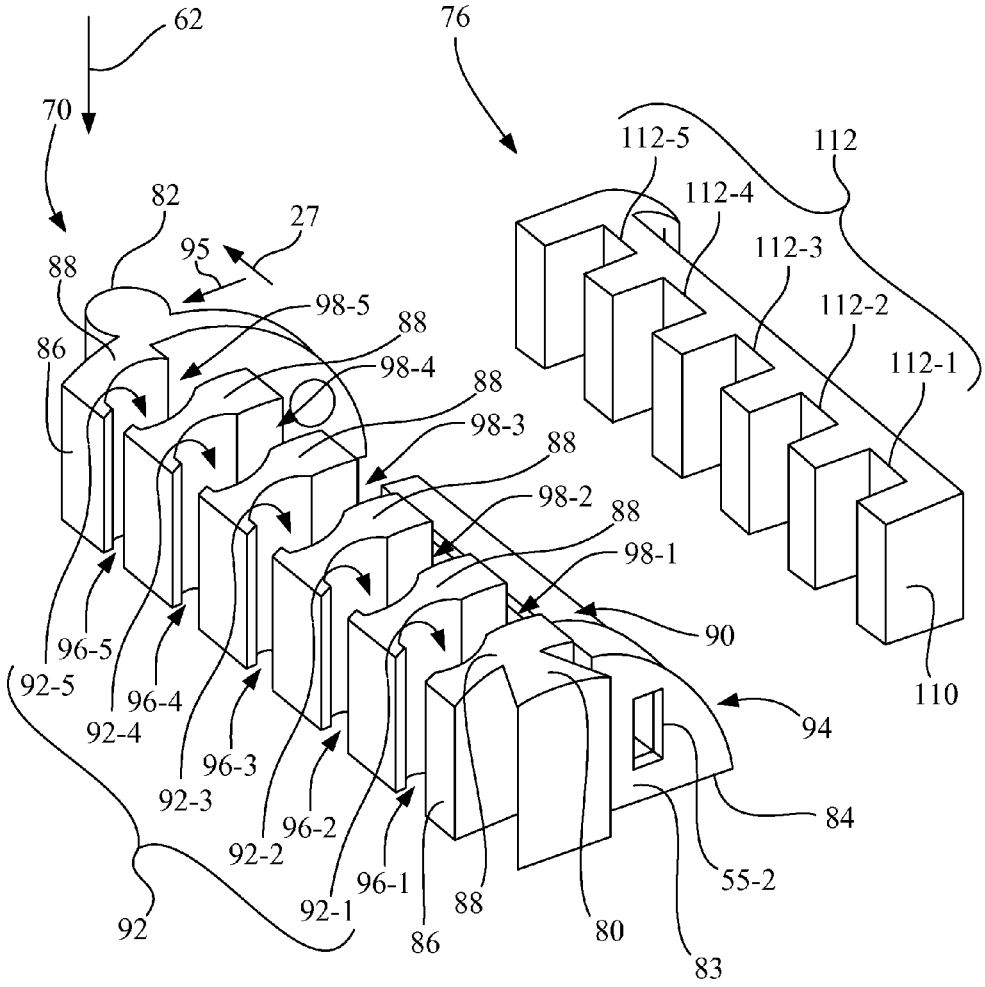
FIG. 5 a further enlarged perspective view of the key follower carrier body and key follower rotation member of FIG. 3.

Key follower carrier body 70 includes a proximal guide feature 80 and a distal guide feature 82 configured to be respectively received by first key follower sub-assembly guide channel 52 and second key follower sub-assembly guide channel 54 of plug body 28. Referring also to FIG. 5, adjacent proximal guide feature 80 is an end wall 83 through which there extends a rekeying aperture 55-2. In the present embodiment, proximal guide feature 80 and first key follower sub-assembly guide channel 52 have a trapezoidal shape. Also, distal guide feature 82 and second key follower sub-assembly guide channel 54 have a generally cylindrical shape. The shapes of proximal guide feature 80 and first key follower sub-assembly guide channel 52, and the shapes of distal guide feature 82 and second key follower sub-assembly guide channel 54, are selected to mount key follower carrier body 70 to plug body 28 and restrain movement of key follower carrier body 70 relative to plug body 28. The shapes of proximal guide feature 80 and first key follower sub-assembly guide channel 52, and the shapes of distal guide feature 82 and second key follower sub-assembly guide channel 54, may be used as an assembly aid to dictate the proper orientation of key follower carrier body 70 relative to plug body 28. Also, the shapes of proximal guide feature 80 and first key follower sub-assembly guide channel 52, and the shapes of distal guide feature 82 and second key follower sub-assembly guide channel 54, may be selected for particular models of lock cylinders to ensure that the proper key follower carrier body 70 is associated with the proper plug body 28.

As shown in FIGS. 3 and 5, key follower carrier body 70 further includes first planar surface 84, a second planar surface 86, a plurality of pillars 88, an intermediate void 90 and a plurality of key follower guide channels 92. When key follower carrier body 70 is mounted to plug body 28, rekeying aperture 55-1 of plug body 28 is longitudinally aligned with rekeying aperture 55-2 of key follower carrier body 70 to form a continuous rekeying tool opening 55 from plug face 40 to intermediate void 90 to permit access to key follower rotation member 76 when lock cylinder 10 is assembled.

First planar surface 84 is orthogonal to second planar surface 86 to define a quarter-section cylinder portion 94 that is received by quarter-section void 50 of plug body 28, with first planar surface 84 being adjacent to planar surface 56, and with second planar surface 86 being adjacent to side wall 58. The plurality of pillars 88 are interposed between proximal guide feature 80 and a distal guide feature 82.

The plurality of key follower guide channels 92 is configured to receive and guide the respective plurality of key followers 72. The plurality of key follower guide channels 92 are arranged in parallel and are positioned along longitudinal axis 18 of lock cylinder body 12 and plug body 28 and orthogonally intersect first planar surface 84 in direction 62. Each channel of the plurality of key follower guide channels 92 is located between a respective pair of the plurality of pillars 88. The plurality of key followers 72 are individually biased toward keyway 46 in direction 62 by a corresponding number of the plurality of biasing springs 74 interposed between cover 38 and the plurality of key followers 72. Each key follower of the plurality of key followers 72 is located to extend across keyway 46 in a direction 95 (see also FIGS. 7A and 7B).

The plurality of key follower guide channels 92 are configured to conform to the shape of the plurality of key followers 72 to guide the bidirectional movement of the plurality of key followers 72 in plurality of key follower guide channels 92 in the direction 62 orthogonal to keyway 46, e.g., parallel to second planar surface 86, while restraining movement of the plurality of key followers 72 in guide channels 92 in all directions transverse to the direction 62, such as in direction 95 transverse to keyway 46, which is also orthogonal to direction 62, and while permitting rotation of the plurality of key followers 72 within the respective plurality of key follower guide channels 92. As will be understood by those skilled in the art with reference to the various figures, the term "restraining" refers to allowing standard engineering clearance tolerances in a respective follower/channel combination without permitting transverse motion of the plurality of key followers 72 between two transverse spaced positions, e.g. in transverse direction 95, in the respective guide channels of the plurality of key follower guide channels 92.

In the present embodiment, referring to FIG. 5, the plurality of key follower guide channels 92, individually identified as 92-1, 92-2, 92-3, 92-4, 92-5, is configured as a plurality of cylindrical bores that extend from the first planar surface 84 through key follower carrier body 70. Each cylindrical bore is bisected by a pair of diametrically opposed slots, identified as rack access slots 96-1, 96-2, 96-3, 96-4, 96-5 and rotation member access slot 98-1, 98-2, 98-3, 98-4, 98-5. In other words, as shown in FIGS. 3, 5, 7A and 7B, each guide channel of the plurality of key follower guide channels 92 has a respective rack access slot 96-1, 96-2, 96-3, 96-4, 96-5 formed as a sidewall opening that extends from the cylindrical bore to second planar surface 86 and in turn to a respective rack of the plurality of racks 32. Also, each guide channel of the plurality of key follower guide channels 92 has a respective rotation member access slot 98-1, 98-2, 98-3, 98-4, 98-5 formed as a sidewall opening that extends from the cylindrical bore to intermediate void 90 and in turn to key follower rotation member 76.

Figure 6:
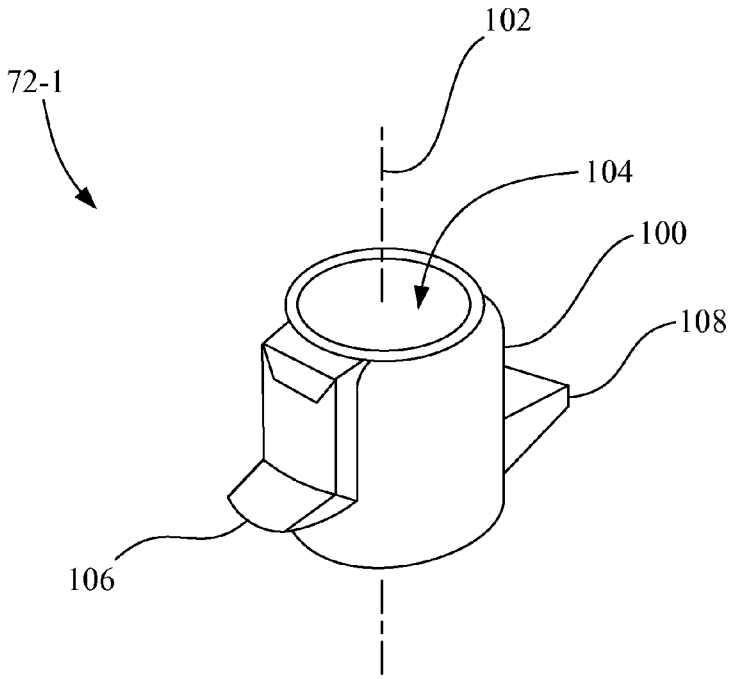
FIG. 6 a further enlarged perspective view of one of the key followers of FIGS. 3 and 4.

Referring again to FIG. 4 in conjunction with FIGS. 3, 5, 7A and 7B, each of the plurality of key followers 72, identified as key followers 72-1, 72-2, 72-3, 72-4, 72-5, are identical in shape and function. Referring to FIG. 6, there is shown an enlarged view of key follower 72-1, which is representative of each of the plurality of key followers 72. With reference to exemplary key follower 72-1 of FIG. 6, each of the plurality of key followers 72 has includes a cup-shaped body 100 that is generally cylindrical having an axis 102 and has a central axial depression 104 for receiving an end portion of a respective biasing spring of the plurality of biasing springs 74. Each biasing spring of the plurality of the plurality of biasing springs 74 may have a non-constant diameter to aid in reception in the respective axial depression 104.

With reference to exemplary key follower 72-1 of FIGS. 3, 4, and 6, each of the plurality of key followers 72 also has a rack engagement protrusion 106 in the form of a single gear tooth in the form of a cantilever member that extends outwardly from cup-shaped body 100. Each rack engagement protrusion 106 of the plurality of key followers 72 is configured and positioned to extend into a respective rack access slot 96-1, 96-2, 96-3, 96-4, 96-5 in key follower carrier body 70. For example, rack engagement protrusion 106 of key follower 72-1 will extend into rack access slot 96-1. Each rack engagement protrusion 106 is configured to be received by a respective follower engagement groove 64 of a respective rack of the plurality of racks 32. The single gear tooth forming rack engagement protrusion 106 may include beveled sides to facilitate smooth engagement with, and disengagement from, the respective rack of the plurality of racks 32 during the rekeying process.

Also, with reference to exemplary key follower 72-1 of FIGS. 3, 4, and 6, each of the plurality of key followers 72 also has a rotation lever 108 in the form of a cantilever member that extends outwardly from cup-shaped body 100. In the present embodiment, rotation lever 108 is positioned on cup-shaped body 100 at a location diametrically opposed to rack engagement protrusion 106. Each rotation lever 108 of the plurality of key followers 72 is configured and positioned to extend into a respective rotation member access slot 98-1, 98-2, 98-3, 98-4, 98-5 in key follower carrier body 70. For example, rotation lever 108 of key follower 72-1 will extend into rotation member access slot 98-1.

Referring again to FIGS. 3 and 5, key follower rotation member 76 includes a body 110 having a plurality of engagement slots 112, individually identified as 112-1, 112-2, 112-3, 112-4 and 112-5. Engagement slots 112-1, 112-2, 112-3, 112-4 and 112-5 are arranged in parallel, and spaced apart in direction 27. Each engagement slot 112-1, 112-2, 112-3, 112-4 and 112-5 is configured and positioned to respectively receive a rotation lever 108 of the respective key follower 72-1, 72-2, 72-3, 72-4, 72-5 of the plurality of key followers 72.

Figure 7A:
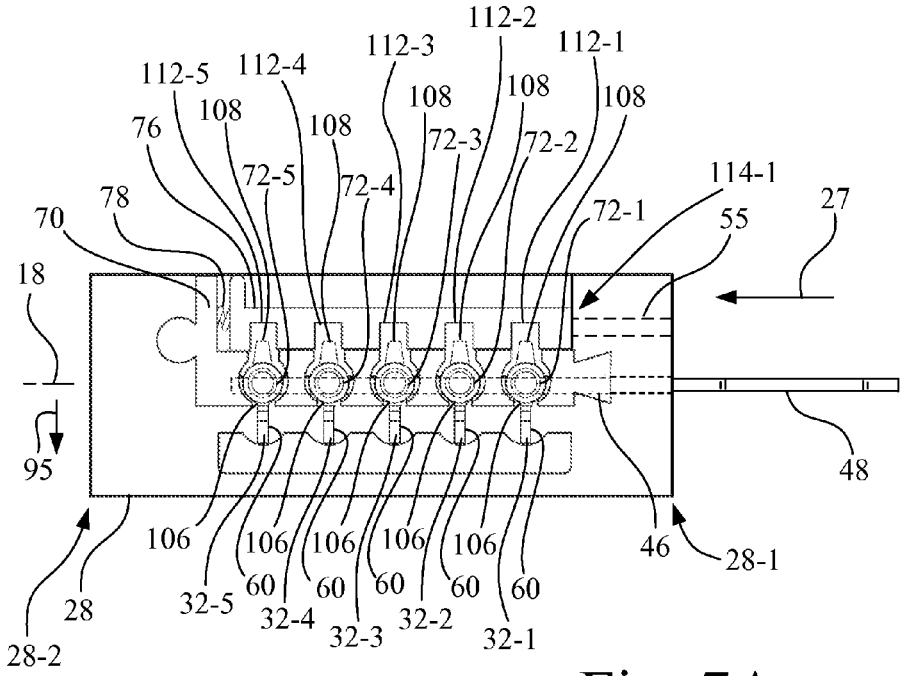
FIG. 7A is a top plan view of the plug assembly of FIG. 3 showing the key follower rotation member in the proximal position to facilitate normal operation of the lock cylinder of FIG. 1, and having a key inserted in the keyway.
Figure 7B:
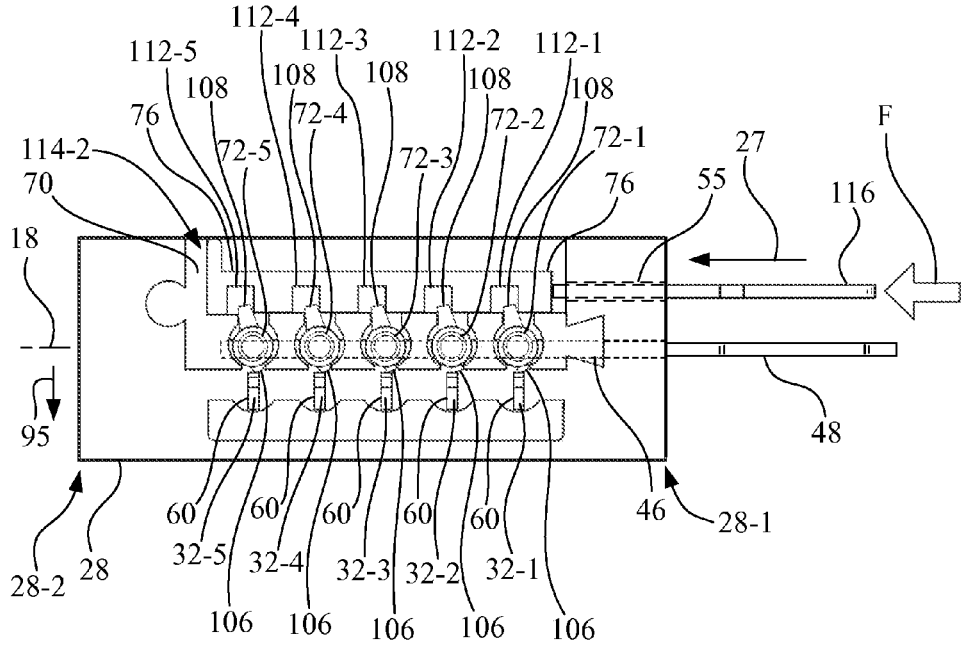
FIG. 7B is a top plan view of the plug assembly of FIG. 3 showing the key follower rotation member in the distal position to facilitate rekeying of lock cylinder of FIG. 1, and having a rekeying tool inserted into the rekeying tool opening.

Key follower rotation member 76 of key follower sub-assembly 30 is positioned in intermediate void 90, and is configured for sliding engagement along the plurality of pillars 88 in a direction 27 parallel to longitudinal axis 18. In other words, key follower rotation member 76 of key follower sub-assembly 30 is longitudinally moveable relative to plug body 28 in direction 27 between the proximal end 28-1 of plug body 28 and the distal end 28-2 of plug body 28, i.e., between a proximal position 114-1 (home position) illustrated in FIG. 7A and a distal position 114-2 (rekeying position) illustrated in FIG. 7B. The proximal position 114-1 illustrated in FIG. 7A is associated with the proximal end 28-1 of plug body 28 and the distal position 114-2 illustrated in FIG. 7B is associated with the distal end 28-2 of plug body 28. Movement of key follower rotation member 76 of key follower sub-assembly 30 between proximal position 114-1 (home position) illustrated in FIG. 7A and distal position 114-2 (rekeying position) illustrated in FIG. 7B is effected by the insertion of a rekeying tool 116 into rekeying tool opening 55 with application of a sufficient force F against key follower rotation member 76 to overcome the biasing force exerted by biasing member 78 to effect a linear displacement of key follower rotation member 76 in direction 27 relative to plug body 28 and key follower carrier body 70.

Referring to FIGS. 3 and 7A, biasing member 78 is interposed between key follower carrier body 70 and key follower rotation member 76. Biasing member 78, e.g., a coil return spring, is engaged with key follower rotation member 76 to continually tend to bias key follower rotation member 76 toward the proximal end 28-1 of plug body 28 to proximal position 114-1.

When key follower rotation member 76 is in proximal position 114-1, rack engagement protrusion 106 of each key follower of the plurality of key followers 72 (individually 72-1, 72-2, 72-3, 72-4, 72-5) is engaged with a respective follower engagement groove 64 of a respective rack of the plurality of racks 32 (individually 32-1, 32-2, 32-3, 32-4, 32-5) to facilitate normal operation of lock cylinder 10 by a valid key, e.g., key 48. During normal (non-rekeying) operation of lock cylinder 10, when a valid key, e.g., key 48, is inserted into keyway 46, the plurality of racks 32 is positioned by the plurality of key followers 72 to longitudinally align relative to longitudinal axis 18 each locking bar engaging groove 63 of the plurality of racks 32 so as to facilitate simultaneous engagement of locking bar 34 with the locking bar engaging groove 63 of each rack of the plurality of racks 32 to allow rotation of plug assembly 14 about longitudinal axis 18 relative to lock cylinder body 12. However, if no key or an invalid key is inserted into keyway 46, then the plurality of racks 32 is positioned by the plurality of key followers 72 such that the locking bar engaging groove 63 of at least one rack of the plurality of racks 32 is not longitudinally aligned with at least one other locking bar engaging groove 63 of at least one other rack of the plurality of racks 32 so as to prevent simultaneous engagement of locking bar 34 with each locking bar engaging groove 63 of the plurality of racks 32 to retain locking bar 34 in engagement with locking bar groove 26 of lock cylinder body 12 to prevent rotation of plug assembly 14 about longitudinal axis 18 relative to lock cylinder body 12.

During movement of key follower rotation member 76 between proximal position 114-1 illustrated in FIG. 7A and distal position 114-2 illustrated in FIG. 7B, engagement slots 112-1, 112-2, 112-3, 112-4 and 112-5 of key follower rotation member 76 engage and move the respective rotation lever 108 of each key follower 72-1, 72-2, 72-3, 72-4, 72-5 of the plurality of key followers 72 in direction 27. In turn, each key follower 72-1, 72-2, 72-3, 72-4, 72-5 of the plurality of key followers 72 is rotated about its respective axis 102 (see FIG. 6). Accordingly, when key follower rotation member 76 has been moved to distal position 114-2 illustrated in FIG. 7B, rack engagement protrusion 106 of each key follower of the plurality of key followers 72 (individually 72-1, 72-2, 72-3, 72-4, 72-5) is disengaged from a respective follower engagement groove 64 of a respective rack of the plurality of racks 32 (individually 32-1, 32-2, 32-3, 32-4, 32-5) to facilitate the rekeying of lock cylinder 10.

FIG. 1 shows lock cylinder 10 with plug assembly 14 in a home (locked) position relative to lock cylinder body 12, wherein side edge 68 (see FIG. 4) of locking bar 34 is engaged with locking bar groove 26 (see FIG. 2) of cylinder wall 22 of lock cylinder body 12. With reference also to FIGS. 4, 7A and 7B, to rekey lock cylinder 10, the valid key 48 is inserted into keyway 46 and plug assembly 14 is rotated about longitudinal axis 18 from the home position to a rekeying position, such that locking bar 34 is moved to engage the locking bar engaging groove 63 of each rack of the plurality of racks 32 so as to maintain the position of the plurality of racks. The rekeying position may be, for example, a position that is rotationally offset approximately 20 to 60 degrees from the home position. Next, rekeying tool 116 is inserted into rekeying tool opening 55 and is moved in direction 27 by force F, which in turn moves key follower rotation member 76 from proximal position 114-1 illustrated in FIG. 7A to distal position 114-2 illustrated in FIG. 7B to rotate the plurality of key followers 72 out of engagement with the plurality of racks 32. Then, the valid key 48 is removed and replaced with a new key to which lock cylinder 10 is to be rekeyed. Upon insertion of the new key (similar to key 48 but having a different key follower lift profile) into keyway 46, each of the plurality of key followers 72 is thus vertically positioned relative to the lift profile of the new key. Next, the force F applied to rekeying tool 116 is released and biasing member 78 moves key follower rotation member 76 from distal position 114-2 illustrated in FIG. 7B toward proximal position 114-1 illustrated in FIG. 7A to thereby reengage the rack engagement protrusion 106 of each key follower of the plurality of key followers 72 with a respective follower engagement groove 64 of a respective rack of the plurality of racks 32. Thereafter, plug assembly 14 is rotated back to the home position, wherein side edge 68 of locking bar 34 is re-engaged with locking bar groove 26 of cylinder wall 22 of lock cylinder body 12. Accordingly, lock cylinder 10 is keyed to the new key and the previous valid key is no longer able to operate lock cylinder 10.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A rekeyable lock cylinder, comprising:

a lock cylinder body including a cylinder wall having an interior surface defining an interior void having a longitudinal axis; and a plug assembly rotatably disposed in said lock cylinder body, said plug assembly including:

a plug body having a plug face and a keyway extending into said plug body from said plug face, said keyway being configured to receive a key;

a plurality of racks movably disposed relative to said plug body;

a plurality of key followers positioned across said keyway and being moveably disposed relative to said plug body, each key follower of said plurality of key followers being configured to engage a respective rack of said plurality of racks; and a key follower rotation member drivably engaged with each key follower of said plurality of key followers, said key follower rotation member being selectively movable to rotate each key follower of said plurality of key followers to thereby disengage each key follower of said plurality of key followers from said respective rack of said plurality of racks to facilitate a keying of said rekeyable lock cylinder.

2. The rekeyable lock cylinder of claim 1, wherein each key follower of said plurality of key followers has a rack engagement protrusion for engaging said respective rack of said plurality of racks and has a rotation lever, said rotation lever of each key follower of said plurality of key followers being drivably engaged by said key follower rotation member, said key follower rotation member being linearly movable relative to said plug body in a direction parallel to said longitudinal axis between a proximal position and a distal position, wherein a movement of said key follower rotation member between said proximal position and said distal position results in a rotation of each key follower of said plurality of key followers relative to said respective rack of said plurality of racks.

3. The rekeyable lock cylinder of claim 2, wherein said movement of said key follower rotation member from said proximal position to said distal position results in said rotation of each key follower of said plurality of key followers relative to said respective rack of said plurality of racks to disengage each rack engagement protrusion of said plurality of key followers from said respective rack of said plurality of racks.

4. The rekeyable lock cylinder of claim 2, comprising a biasing member engaged with said key follower rotation member to bias said key follower rotation member toward said proximal position.

5. The rekeyable lock cylinder of claim 4, wherein said plug face of said plug body has a rekeying tool opening leading to said key follower rotation member, said rekeying tool opening being configured to receive a rekeying tool, wherein application of a force to said rekeying tool positioned in said rekeying tool opening in said direction parallel to said longitudinal axis effects said movement of said key follower rotation member from said proximal position to said distal position.

6. The rekeyable lock cylinder of claim 1, comprising:

a key follower carrier body mounted to said plug body, said key follower carrier body including a plurality of key follower guide channels configured to receive and guide said plurality of key followers in bidirectional movement in a direction orthogonal to said keyway, each guide channel of said plurality of key follower guide channels having a respective rack access slot formed as a sidewall opening slot that extends from said respective guide channel to said respective rack of said plurality of racks, and each guide channel of said plurality of key follower guide channels having a respective rotation member access slot that extends from said respective guide channel to said key follower rotation member; and wherein each key follower of said plurality of key followers has a rack engagement protrusion extending into said respective rack access slot to facilitate selective engagement of said rack engagement protrusion with said respective rack of said plurality of racks, and wherein each key follower of said plurality of key followers has a rotation lever extending into said respective rotation member access slot to facilitate driving engagement of said rotation lever with said key follower rotation member.

7. The rekeyable lock cylinder of claim 6, wherein said key follower rotation member is movable between a proximal position and a distal position relative to said plug body, wherein a movement of said key follower rotation member from said proximal position to said distal position results in a rotation of each key follower of said plurality of key followers relative to said respective rack of said plurality of racks to disengage each rack engagement protrusion of said plurality of key followers from said respective rack of said plurality of racks.

8. The rekeyable lock cylinder of claim 7, said key follower carrier body having a void with said key follower rotation member being positioned in said void, and comprising a biasing member interposed between said key follower carrier body and said key follower rotation member to bias said key follower rotation member toward said proximal position.

9. The rekeyable lock cylinder of claim 8, wherein said plug face of said plug body has a first rekeying aperture and said key follower carrier body has a second rekeying aperture, said first rekeying aperture and said second rekeying aperture being longitudinally aligned to define a rekeying tool opening leading from said plug face to said key follower rotation member, said rekeying tool opening being configured to receive a rekeying tool, wherein application of a force to said rekeying tool positioned in said rekeying tool opening in said direction parallel to said longitudinal axis effects said movement of said key follower rotation member from said proximal position to said distal position.

10. The rekeyable lock cylinder of claim 1, said lock cylinder body having a locking bar groove at said interior void that extends parallel to said longitudinal axis and, further comprising:

a locking bar disposed within said lock cylinder body, and wherein each rack of said plurality of racks has a locking bar engaging groove to selectively receive said locking bar, said plurality of racks being positioned by said plurality of key followers to longitudinally align each locking bar engaging groove of said plurality of racks to facilitate simultaneous engagement of said locking bar with said locking bar engaging groove of each rack of said plurality of racks to allow rotation of said plug assembly about said longitudinal axis relative to said lock cylinder body when a valid key is inserted into said keyway; and said plurality of racks being positioned by said plurality of key followers such that said locking bar engaging groove of at least one rack of said plurality of racks is not longitudinally aligned with at least one other locking bar engaging groove of at least one other rack of said plurality of racks to prevent simultaneous engagement of said locking bar with each locking bar engaging groove of said plurality of racks to retain said locking bar in engagement with said locking bar groove of said lock cylinder body to prevent rotation of said plug assembly about said longitudinal axis relative to said lock cylinder body if no key or an invalid key is inserted into said keyway.

11. A rekeyable lock cylinder, comprising:

a lock cylinder body including a cylinder wall having an interior surface defining an interior void having a longitudinal axis; and a plug assembly rotatably disposed in said lock cylinder body, said plug assembly including:

a plug body having a plug face and a keyway extending into said plug body from said plug face, said keyway being configured to receive a key;

a plurality of racks movably disposed relative to said plug body;

a plurality of key followers positioned across said keyway and being moveably disposed relative to said plug body, each key follower of said plurality of key followers being rotatable relative to said plurality of racks, each key follower of said plurality of key followers having a rotation lever, and each key follower of said plurality of key followers having a rack engagement protrusion; and a key follower rotation member drivably engaged with each rotation lever of each key follower of said plurality of key followers, said key follower rotation member being movable in a first direction to rotate each key follower of said plurality of key followers to thereby disengage each rack engagement protrusion of said plurality of key followers from said respective rack of said plurality of racks, said key follower rotation member being movable in a second direction to rotate each key follower of said plurality of key followers to thereby engage each rack engagement protrusion of said plurality of key followers with said respective rack of said plurality of racks.

12. The rekeyable lock cylinder of claim 11, wherein said key follower rotation member is movable between a proximal position and a distal position relative to said plug body, wherein a movement of said key follower rotation member from said proximal position to said distal position results in a rotation of each key follower of said plurality of key followers relative to said respective rack of said plurality of racks to disengage each rack engagement protrusion of said plurality of key followers from said respective rack of said plurality of racks.

13. The rekeyable lock cylinder of claim 12, comprising a biasing member engaged with said key follower rotation member to bias said key follower rotation member toward said proximal position.

14. The rekeyable lock cylinder of claim 12, wherein said plug face of said plug body has a rekeying tool opening leading to said key follower rotation member, said rekeying tool opening being configured to receive a rekeying tool, wherein application of a force to said rekeying tool positioned in said rekeying tool opening in a direction parallel to said longitudinal axis effects said movement of said key follower rotation member from said proximal position to said distal position.

15. The rekeyable lock cylinder of claim 11, comprising:

a key follower carrier body mounted to said plug body, said key follower carrier body including a plurality of key follower guide channels configured to receive and guide said plurality of key followers in bidirectional movement in a direction orthogonal to said keyway, each guide channel of said plurality of key follower guide channels having a respective rack access slot formed as a sidewall opening slot that extends from said respective guide channel to said respective rack of said plurality of racks, and each guide channel of said plurality of key follower guide channels having a respective rotation member access slot that extends from said respective guide channel to said key follower rotation member; and wherein each rack engagement protrusion of said plurality of key followers extends into said respective rack access slot to facilitate selective engagement of each rack engagement protrusion with said respective rack of said plurality of racks, and wherein each rotation lever of said plurality of key followers extends into said respective rotation member access slot to facilitate driving engagement of each rotation lever with said key follower rotation member.

16. The rekeyable lock cylinder of claim 15, said key follower carrier body having a void with said key follower rotation member being positioned in said void, and comprising a biasing member interposed between key follower carrier body and said key follower rotation member to bias said key follower rotation member toward a proximal position relative to said plug body.

17. The rekeyable lock cylinder of claim 16, wherein said plug face of said plug body has a first rekeying aperture and said key follower carrier body has a second rekeying aperture, said first rekeying aperture and said second rekeying aperture being longitudinally aligned to define a rekeying tool opening leading from said plug face to said key follower rotation member, said rekeying tool opening being configured to receive a rekeying tool, wherein application of a force to said rekeying tool positioned in said rekeying tool opening in a direction parallel to said longitudinal axis effects said movement of said key follower rotation member from said proximal position to a distal position relative to said plug body.

18. A method for keying a lock cylinder, said lock cylinder having a lock cylinder body including a cylinder wall having an interior surface defining an interior void having a longitudinal axis and having a plug assembly rotatably disposed in said lock cylinder body, said plug assembly including a plug body having a plug face and a keyway extending into said plug body from said plug face, said keyway being configured to receive a key, a locking bar, a plurality of racks movably disposed relative to said plug body, and a plurality of key followers positioned across said keyway and being moveably disposed relative to said plug body, the method comprising:

inserting a valid key in said keyway;

rotating said plug assembly relative to said lock cylinder body from a home position to a rekeying position wherein a position of each rack of said plurality of racks is maintained by said locking bar;

rotating said plurality of key followers to disengage said plurality of key followers from said plurality of racks;

removing said valid key from said keyway;

inserting a second key into said keyway;

rotating said plurality of key followers to reengage said plurality of key followers with said plurality of racks; and rotating said plug assembly relative to said lock cylinder body from said rekeying position to said home position to complete rekeying of said lock cylinder to said second key.

19. The method for keying a lock cylinder of claim 18, said plug assembly including a key follower rotation member drivably engaged with said plurality of key followers to effect a rotation of said plurality of key followers, said plug face having a rekeying tool opening that extend to said key follower rotation member, the method comprising:

effecting said rotating of said plurality of key followers to disengage said plurality of key followers from said plurality of racks by inserting a rekeying tool into said rekeying tool opening and applying a force to said rekeying tool to move said key follower rotation member from a first position to a second position.

* * * * *